US007006653B2

(12) United States Patent
Guenther

(10) Patent No.: US 7,006,653 B2
(45) **Date of Patent: *Feb. 28, 2006**

(54) COMPACT HIGH PERFORMANCE SPEAKER

(76) Inventor: Godehard A. Guenther, 75 Folsom St., San Francisco, CA (US) 94105

( * ) Notice: Subject to any disclaimer, the term of this patent is extended or adjusted under 35 U.S.C. 154(b) by 0 days.

This patent is subject to a terminal disclaimer.

(21) Appl. No.: 10/456,990

(22) Filed: Jun. 6, 2003

(65) Prior Publication Data

US 2004/0076308 A1 Apr. 22, 2004

Related U.S. Application Data

(63) Continuation of application No. 09/895,002, filed on Jun. 27, 2001, now Pat. No. 6,611,606.
(60) Provisional application No. 60/214,689, filed on Jun. 27, 2000, and provisional application No. 60/214,704, filed on Jun. 27, 2000.

(51) Int. Cl.
*H04R 25/00* (2006.01)

(52) U.S. Cl. ..... 381/409; 381/421; 381/412
(58) Field of Classification Search ..... 381/396, 381/409, 412, 414, 419–422
See application file for complete search history.

(56) References Cited

U.S. PATENT DOCUMENTS

| | | | |
|---|---|---|---|
| 2,769,942 | A | 11/1956 | Hassan |
| 3,067,366 | A | 12/1962 | Hofman |
| 3,340,604 | A | 9/1967 | Parain |
| 3,838,216 | A | 9/1974 | Watkins |
| 3,910,374 | A | 10/1975 | Holehouse |
| 3,948,346 | A | 4/1976 | Schindler |
| 3,979,566 | A | 9/1976 | Willy |

(Continued)

*Primary Examiner*—Suhan Ni
(74) *Attorney, Agent, or Firm*—David J. Powsner; Nutter McClennen & Fish LLP

(57) ABSTRACT

A speaker has an annular magnet structure. First and second annular magnets are arranged concentrically with each other and connected by a shunt at one end and a pole-defining structure at the other end to concentrate magnetic flux in a cylindrical voice coil gap. The shunt and pole structure are stacked such that the combined magnetic assembly has an opening extending centrally therethrough. A voice coil rides in the cylindrical magnetic flux gap and its leads are brought out through the opening to the other side of the magnet. When used with an enclosure, the diaphragm of the speaker may communicate through the central opening with the volume of a tuned enclosure extending behind the speaker, or the opening may serve as a port of the enclosure, allowing further degrees of control over total acoustics.

6 Claims, 18 Drawing Sheets

U.S. PATENT DOCUMENTS 4,122,315 A 10/1978 Schroeder et al.
4,151,379 A 4/1979 Ashworth
4,201,886 A 5/1980 Nagel
4,220,832 A 9/1980 Nagel
4,300,022 A 11/1981 Hasting-James et al.
4,401,857 A 8/1983 Morikawa
4,440,259 A 4/1984 Strohbeen
4,472,604 A 9/1984 Nakamura et al.
4,477,699 A 10/1984 Wada et al.
4,492,826 A 1/1985 Chiu
4,552,242 A 11/1985 Kashiwabara
4,565,905 A 1/1986 Nation
4,577,069 A 3/1986 Keezer
4,783,824 A 11/1988 Kobayashi
4,799,264 A 1/1989 Plummer
4,821,331 A 4/1989 Murayama et al.
4,965,837 A 10/1990 Murayama et al.
5,040,221 A 8/1991 Edwards et al.
5,115,884 A 5/1992 Falco
5,155,578 A 10/1992 Lim et al.
5,333,204 A 7/1994 Hamada et al.
5,390,257 A 2/1995 Oslac et al.
5,402,503 A 3/1995 Prokisch
5,446,797 A 8/1995 Paddock
5,519,178 A 5/1996 Ritto et al.
5,524,151 A 6/1996 Bleim
5,548,657 A 8/1996 Fincham
5,583,945 A 12/1996 Iijima et al.
5,587,615 A 12/1996 Murray et al.
5,594,805 A 1/1997 Sakamoto et al.
5,604,815 A 2/1997 Paddock
5,657,392 A 8/1997 Bouchard
5,715,324 A 2/1998 Tanabe et al.
5,744,761 A 4/1998 Ogura et al.
5,748,760 A 5/1998 Button
5,751,828 A 5/1998 Ueda et al.
5,802,189 A 9/1998 Blodget
5,802,191 A 9/1998 Guenther
5,835,612 A 11/1998 Fujihira et al.
5,847,333 A 12/1998 D'Hoogh
5,867,583 A 2/1999 Hazelwood et al.
5,917,922 A 6/1999 Kukurudza
6,067,364 A 5/2000 Brinkley et al.
6,611,606 B1 * 8/2003 Guenther ..... 381/421

* cited by examiner

COMPACT HIGH PERFORMANCE SPEAKER

CROSS-REFERENCE TO RELATED APPLICATIONS

This application is a continuation of U.S. Ser. No. 09/895,002, entitled "Compact High Performance Speaker." filed on Jun. 27, 2001, now U.S. Pat. No. 6,611,606 and is related to and claims the priority under 35 USC § 119 (e) of U.S. Provisional Application 60/214,689, filed Jun. 27, 2000. Both of the aforementioned applications, and commonly owned U.S. Provisional Application 60/214,704, filed Jun. 27, 2000, are incorporated herein by reference in their entirety.

BACKGROUND OF THE INVENTION

The present invention relates to audio speakers and particularly to compact loud speakers. In recent years, the number of applications to which compact speakers are put has grown substantially. This growth is partly due to the arrival of numerous new forms of consumer electronics and personal electronic music playing devices, many of which require or promote the use of accessory speakers for full volume delivery of high quality sound. The increased use of compact speakers has also been fueled by a general trend toward smaller bookshelf or desktop systems, rather than the cabinet work and larger speaker enclosures that had formed the benchmark for audio performance over many decades.

For many of these applications light weight and portability are important. For still others, cost is a major factor. For yet other applications, it may be desirable to optimize the performance of such a speaker in relation to a cabinet or other speaker housing. In such cases, detailed consideration must be given to the structure and acoustics both of the speaker and of the housing. However, the trend to small speakers poses numerous technical problems, especially at the lower frequency end of the spectrum, since a smaller diaphragm is less effective at radiating lower frequencies and, moreover, has a higher natural resonance. A full panoply of compensatory features, such as the use of higher drive current, longer throw coil constructions, more powerful magnet gap, improved diaphragm materials and new cabinet configurations may be needed to achieve the desired operation in a smaller size system.

Thus, it would be desirable to provide an improved compact speaker.

It would also be desirable to provide a housing in which the performance of a compact speaker is further enhanced.

It would also be desirable to devise such a speaker and housing, wherein the housing itself is adapted to be mounted in a cabinet, a wall space or other location as a unit, and to thereby adapt the mounting structure without extensive acoustic engineering or individualized design considerations.

SUMMARY OF THE INVENTION

One or more of these and other desirable ends are obtained with the present invention by a speaker wherein first and second annular magnets are arranged concentrically with each other and connected by a shunt structure at one end and a pole-defining structure at the other end to concentrate magnetic flux in a cylindrical gap. Like the magnets, the shunt and the pole structure are also annular, and these are stacked such that the combined magnetic assembly has an opening extending centrally therethrough.

The voice coil of a speaker rides in the cylindrical magnetic flux gap and its drive leads may be brought out behind the speaker, through the central opening. In various embodiments the diaphragm of the speaker may communicate through the central opening with the volume of a tuned enclosure situated behind the speaker, thus allowing further control over total acoustics.

In accordance with one aspect of the invention, the annular magnets are axially poled and of opposite polarity, separated by a cylindrical magnet gap between the two magnets. Two shaped pole pieces, one lying against the upper face of each magnet, define a shallow voice coil gap of higher flux density substantially contiguous with the magnet gap. The construction may be applied to an assembly using two neodymium ring magnets, of 25 millimeter and 36 millimeter outer diameters, to achieve a total flux density over 1.4 Tesla in a one-inch voice coil gap with a total speaker weight below two ounces and a total energy of 100 milliWatt seconds in the gap. The mass of the costly neodymium is thus minimized while the available flux is efficiently focused in the gap and overall speaker performance excels. In particular, the magnet achieves this high energy in a very shallow gap, allowing the diaphragm to be strongly driven with small excursion. The central through opening facilitates lead handling, both during speaker assembly and during subsequent speaker installation. The opening may also be exploited to permits an effective level of either damped or resonant coupling to be achieved in a relatively shallow chamber. The chamber may be a ported enclosure that mounts in a flush or shallow panel or wall.

BRIEF DESCRIPTION OF THE DRAWINGS

The invention will be understood from the description herein of illustrative embodiments and comparative examples, taken together with the figures, wherein:

FIGS. 9–12A, 12B illustrate features comparable to those of FIGS. 1A, 2, 3, 4A and 4B, respectively, for a solid disk magnet structure of a second comparison construction; and FIGS. 13–16A, 16B illustrate features comparable to those of FIGS. 1A, 2, 3, 4A and 4B, respectively, for a solid disk magnet structure of a third comparison construction.

DETAILED DESCRIPTION OF THE INVENTION

The present invention seeks to provide an improved and highly effective speaker employing low cost metal parts for its magnetic substructure. In general, a speaker has a permanent magnet which, in the case of smaller high performance speakers, is preferably a rare earth magnet such as a neodymium magnet. The magnetic substructure also includes a shunt and pole piece structure that concentrate the field in a high flux gap where a cylindrical voice coil attached to the speaker diaphragm moves in accordance with an applied drive current signal.

In designing such a speaker, one may commence with an existing design and seek to optimize the magnetic performance of a new speaker based on one parameter deemed most important, such as flux, weight, physical depth, or cost. This approach, while intuitively straightforward, does not necessarily enhance, and may detract from, the other parameters which are not optimized. The present invention provides a novel construction that enhances several performance parameters at once to produce a very compact and highly effective speaker.

Reference is hereby made to Applicant's earlier patents and patent applications as follows: U.S. Pat. No. 5,802,191, U.S. application Ser. No. 09/100,411, U.S. application Ser. No. 09/439,416 and corresponding international application PCT/US99/27011, U.S. application Ser. No. 09/639,416 and corresponding international application PCT/US00/22119. Each of the foregoing patents and applications is incorporated by reference herein in its entirety.

Figure 1:
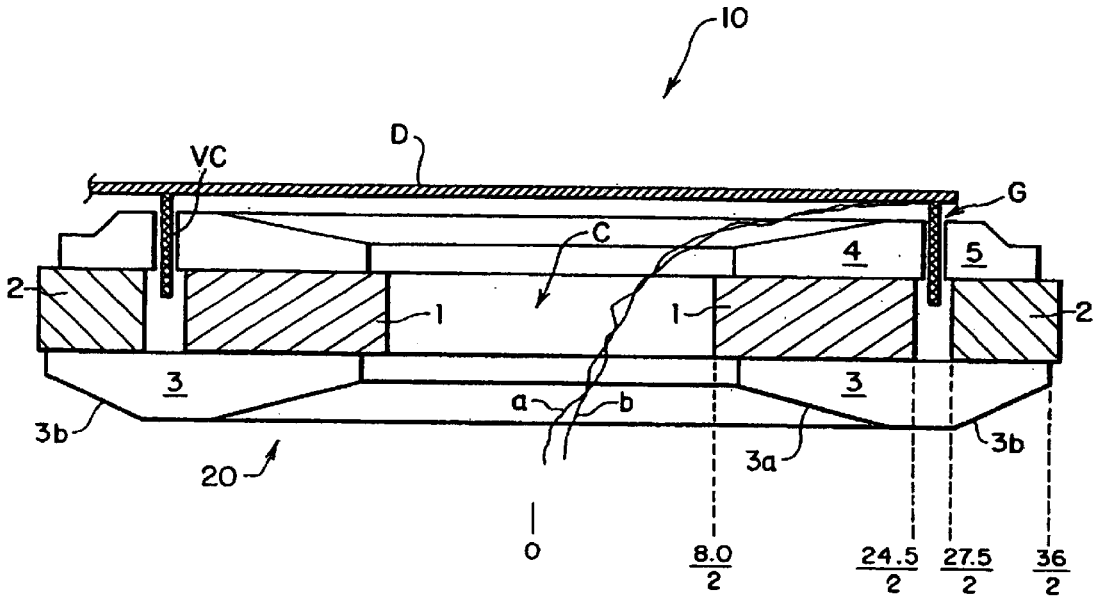
FIG. 1 illustrates a high performance magnet structure for the voice coil of a speaker in accordance with the present invention.

FIG. 1 illustrates one embodiment of a speaker 10 in accordance with the present invention, showing its magnet structure 20 in detail, and its diaphragm D and voice coil VC schematically. The voice coil VC which may, for example, consist of a copper or other conductive winding on a cylindrical bobbin (formed, e.g., of Kapton sheet), rides in a magnetic gap G where the magnet structure 20 concentrates the magnetic flux. The diaphragm D is shown as a flat sheet extending across the region spanned by the cylindrical voice coil VC. Such a diaphragm is typically suspended about its outer periphery by a flexible rubber or polymer band attaching it to a frame (not shown). In other embodiments, however, the diaphragm may be a domed or concave diaphragm spanning the coil diameter, or may be a sheet or cone positioned such that it extends primarily around the outside of the periphery of the voice coil to mount in a much larger frame. In this case, an additional annular band of flexible but dimensionally stiff material typically attaches to the voice coil or to the diaphragm in the region of the voice coil to maintain centering in the magnetic gap G. At the outer peripheral edge of the cone, another flexible band typically attaches the diaphragm to the speaker frame.

As shown in FIG. 1, the magnetic structure 20 of the speaker assembly 10 includes first and second annular magnets 1, 2 that are positioned coaxially with each other and connected together by a shunt member 3 on one side of the magnets. In the illustrated embodiment, the shunt member 3, rather than being a flat plate or sheet, is a shaped member, thinning toward its radially inner and radially outer edges. That is the sides 3*a* and 3*b* are beveled (or may be rounded), falling to a thinner body away from its middle portion. On the other side of the magnets 1, 2 are respective shaped pole pieces 4, 5. As shown in FIG. 1, the inner and outer cylindrical magnets 1, 2 are positioned concentrically, with a small space between the outer periphery of the inner magnet and the inner wall of the outer magnet. The pole pieces 4, 5 each consist of or include an annular ring, and each sits on top of the respective magnet such that the separation between opposing faces of the two pole pieces forms the voice coil gap G. In the illustrated embodiment gap G is smaller than the underlying space between the two magnets, and is concentric therewith. By way of scale, in one embodiment of the present invention, the voice coil C has a diameter of about one inch and the inner magnet 1 has an external diameter of 24.5 millimeters with an eight millimeter central opening. The magnet 2 is positioned across a 1.5 millimeter gap and extends to 36 millimeters diameter. The pole pieces 4, 5 narrow the magnetic gap so that gap G is e.g., one millimeter. Like the keeper 3, the pole pieces 4, 5 are thicker proximate to the gap G, and are tapered or thinned nearer to the radial inner and outer edges, respectively, of the assembly.

Figure 1A:
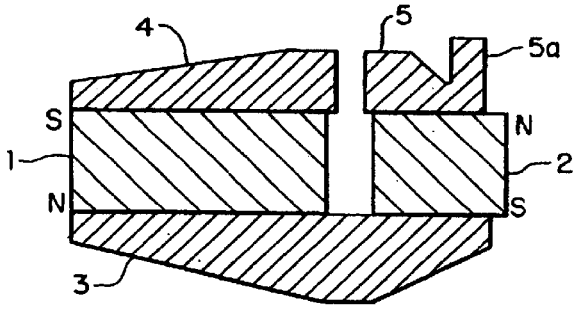
FIG. 1A illustrates another embodiment of the invention.

FIG. 1A illustrates the magnetic structure of a prototype speaker in accordance with the present invention, showing a section taken along a radial plane through one side of the speaker magnets. In this embodiment, the outer pole piece 5 possesses a projecting peripheral stand 5*a*. The edge of the diaphragm (for a flat diaphragm as shown in FIG. 1) mayy attache to the stand 5*a*. The pole pieces are formed of a suitable material, e.g., iron or steel, and their shape serves to better utilize the flux, concentrating it in the voice coil gap, as well as to provide relief or clearance so that the diaphragm does not buzz.

Figure 3:
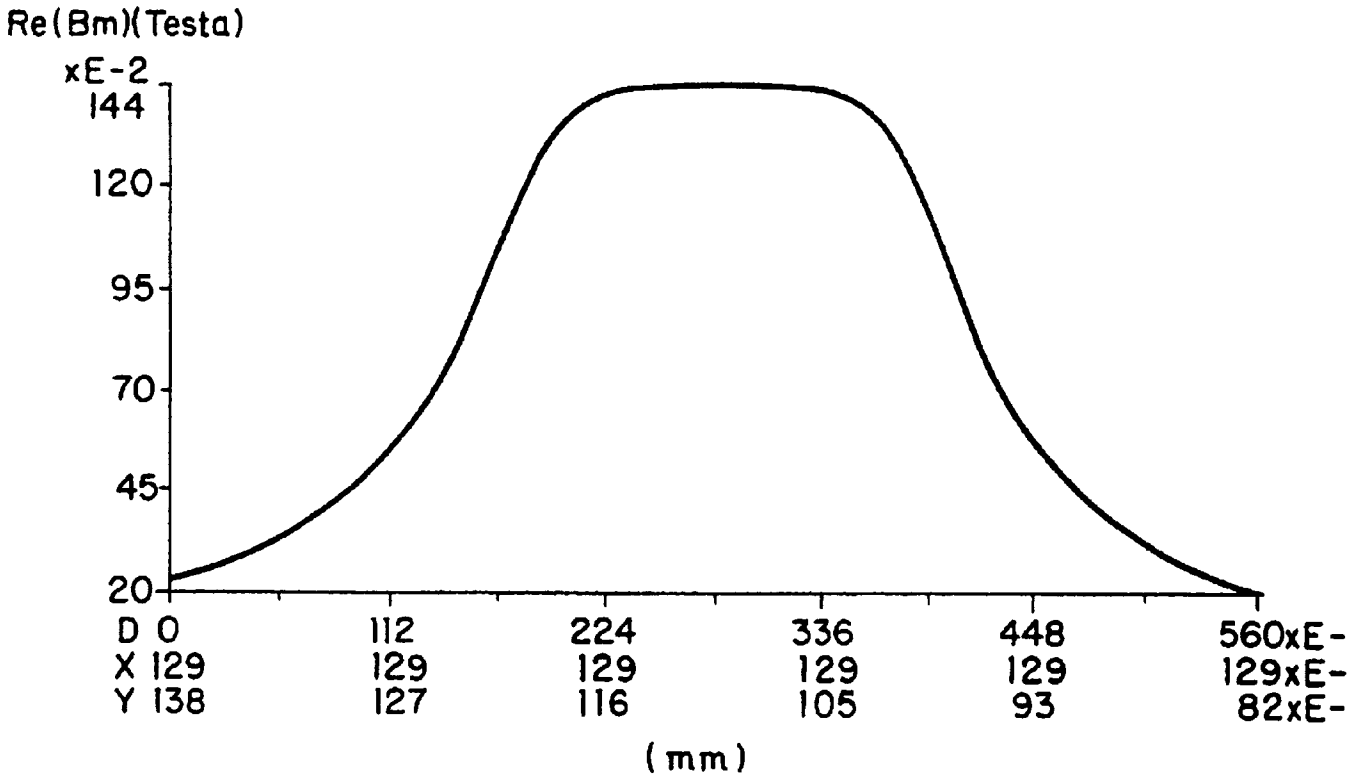
FIG. 3 is a graph of flux density across the gap of the structure of FIG. 1A.

FIG. 3 graphs the flux density achieved in the gap. As shown the dual concentric ring magnet structure delivers a flux density of 1.44 Tesla over a 2 millimeter by 1 millimeter gap; the total gap energy is 100 milliWatt seconds.

Figure 2:
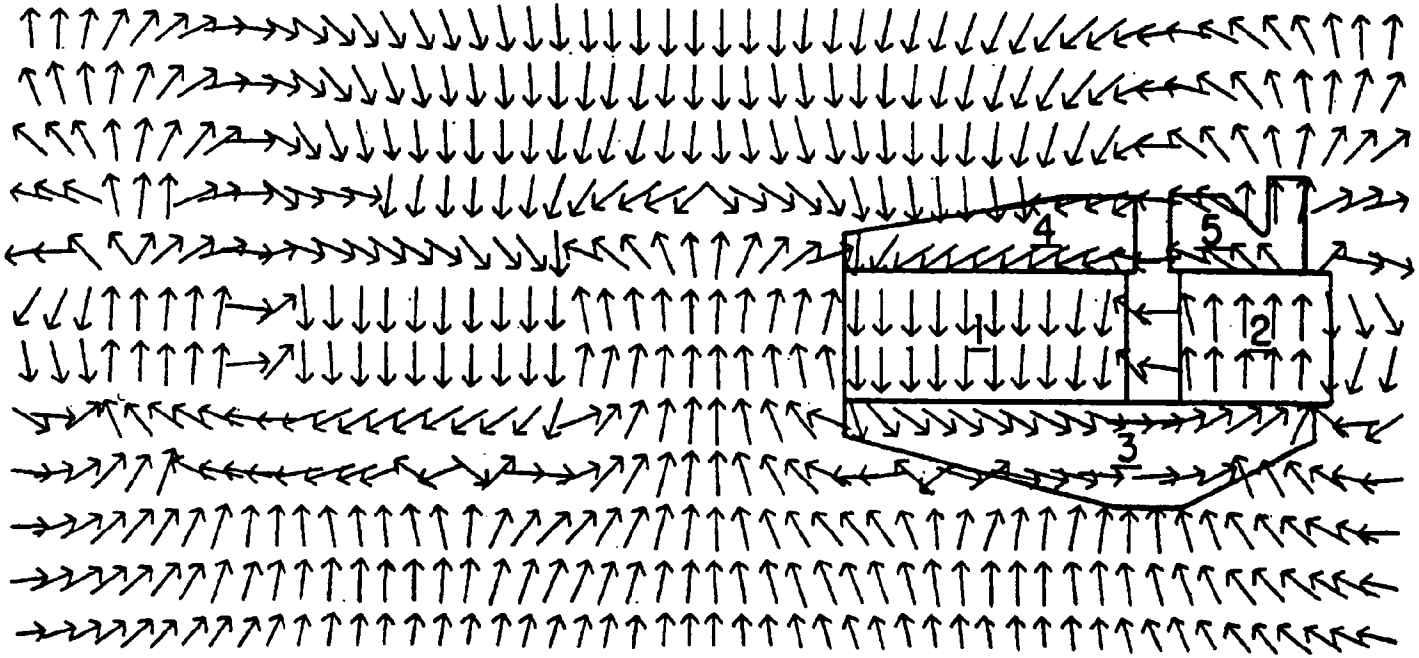
FIG. 2 illustrates field vectors in the magnetic structure of FIG. 1A.

FIG. 2 illustrates the vectors in the magnetic structure of FIG. 1A. Solid lines are inserted in the right hand side of the Figure to illustrate the metal/magnetic parts, and these are—dentified with numerals corresponding to the numerals of FIG. 1. The magnets are poled N–S along the axis of the ring, and the outer ring magnet 2 is poled in the opposite direction from the inner one. In this embodiment, the outer pole piece 5 includes the extending stub or band portion 5*a* at its outer periphery, which as illustrated in the succeeding detail Figures, affects the outer field lines. The pole and shunt structure applied to oppositely poled ring magnets more efficiently uses the available magnetic material to focus a high flux density in the gap G.

As further shown in FIG. 1, the inner magnet 1 together with the keeper 3 and inner pole piece 4 are all annular elements defining a physical opening C through the center of the magnet assembly. Speaker input leads a,b pass through this central opening and connect to the voice coil VC. It should be noted that the representation of input drive lines is schematic only. A single lead may pass through the opening with a second lead grounded to metallic structure of the speaker. Furthermore, the leads a,b need not be wires as shown but make take other forms such as a flexible cable or microlithographically formed conductive elements in which a plastic sheet may encase and reinforce the metal conductor(s). Furthermore, the drive line may connect from the voice coil to a surface terminal pad structure on the diaphragm D, before connecting to the conductors that pass through the central aperture C. Other connection techniques known in the art may be employed.

However, advantageously, the drive or lead in conductors may pass directly through the aperture. This architecture thus eliminates the step of attaching the voice coil wires to a terminal strip or connecting pad stationed on the diaphragm or on the fabric centering support (of a cone). Since such intermediate connection has required delicate manipulations inside the speaker frame, this has been a time consuming fabrication step in the prior art.

The opening C also provides air communication between the back and front of the speaker. Thus, when the diaphragm D extends across the full face of the magnet assembly, its behavior may be affected by the stiffness of the air column through the opening, e.g., into the cabinet or other space behind the magnet. When the diaphragm extends peripherally out from the voice coil without a central cap or dome, this opening may be used to relieve such cabinet stiffness, and/or to vent or port sound from the cabinet interior. Thus, the magnet opening allows acoustic coupling to tailor the system response, and permits one to vent an enclosure to reduce air stiffness in smaller enclosures.

Figure 4A:
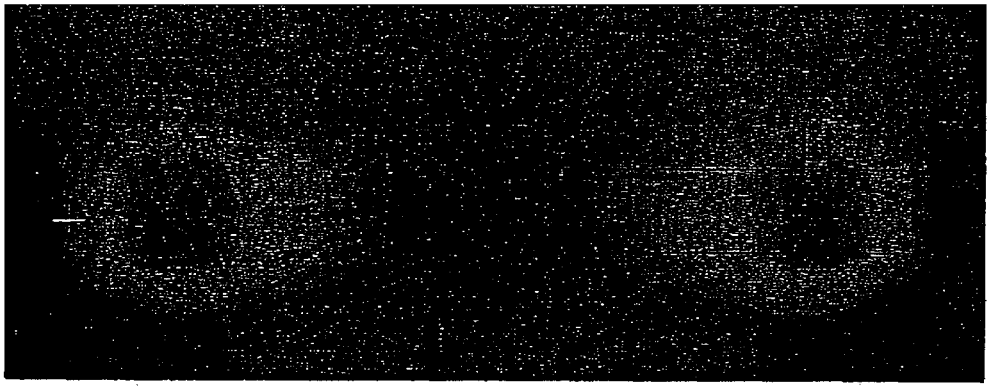
FIGS. 4A and 4B are illustrations of flux paths and field lines, respectively, for the structure of FIG. 1A.
Figure 4B:
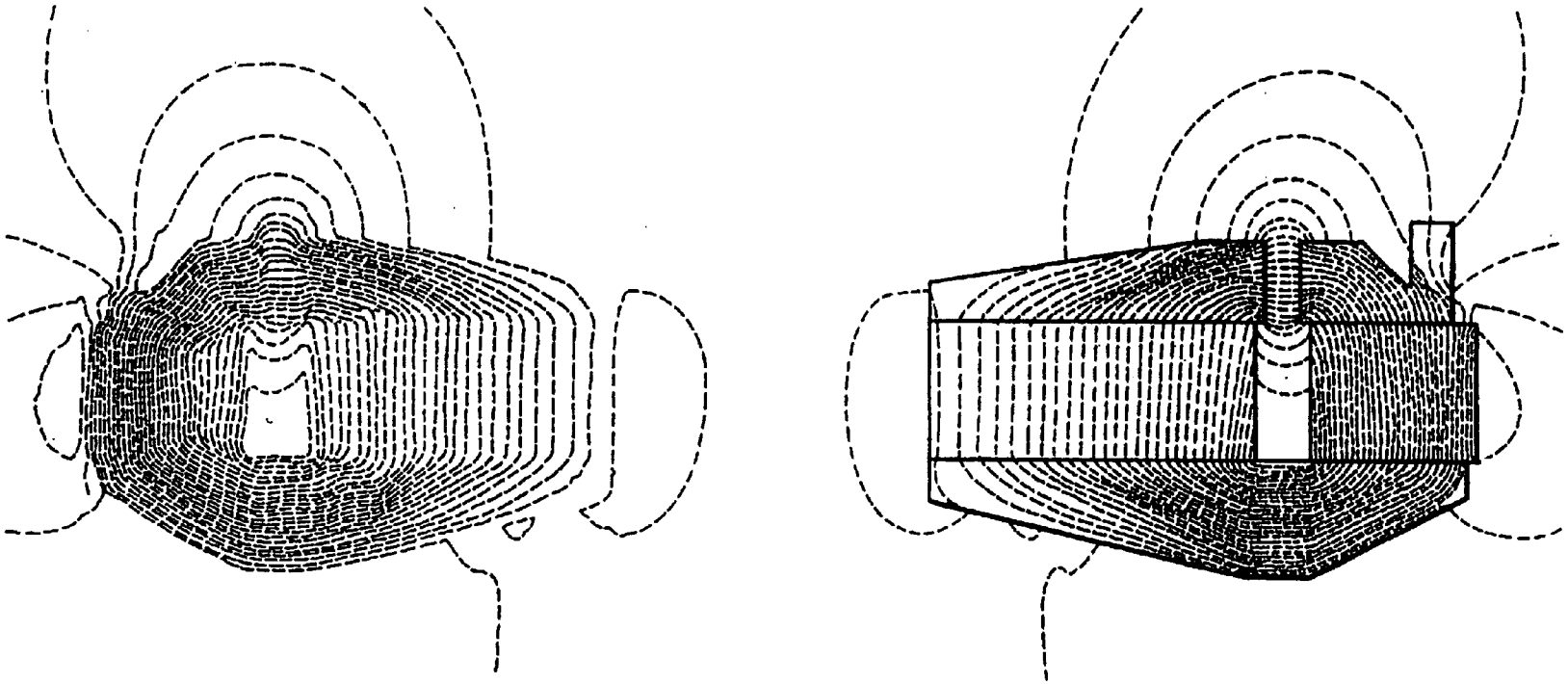
Figure 5:
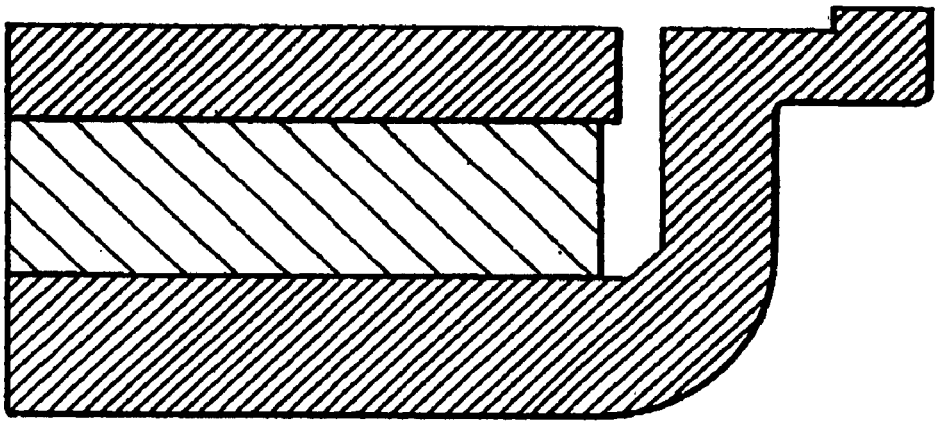
FIGS. 5–8 illustrate features comparable to those of FIGS. 1A, 2, 3, and 4A, respectively, for a solid disk magnet structure of a first comparison construction.
Figure 6:
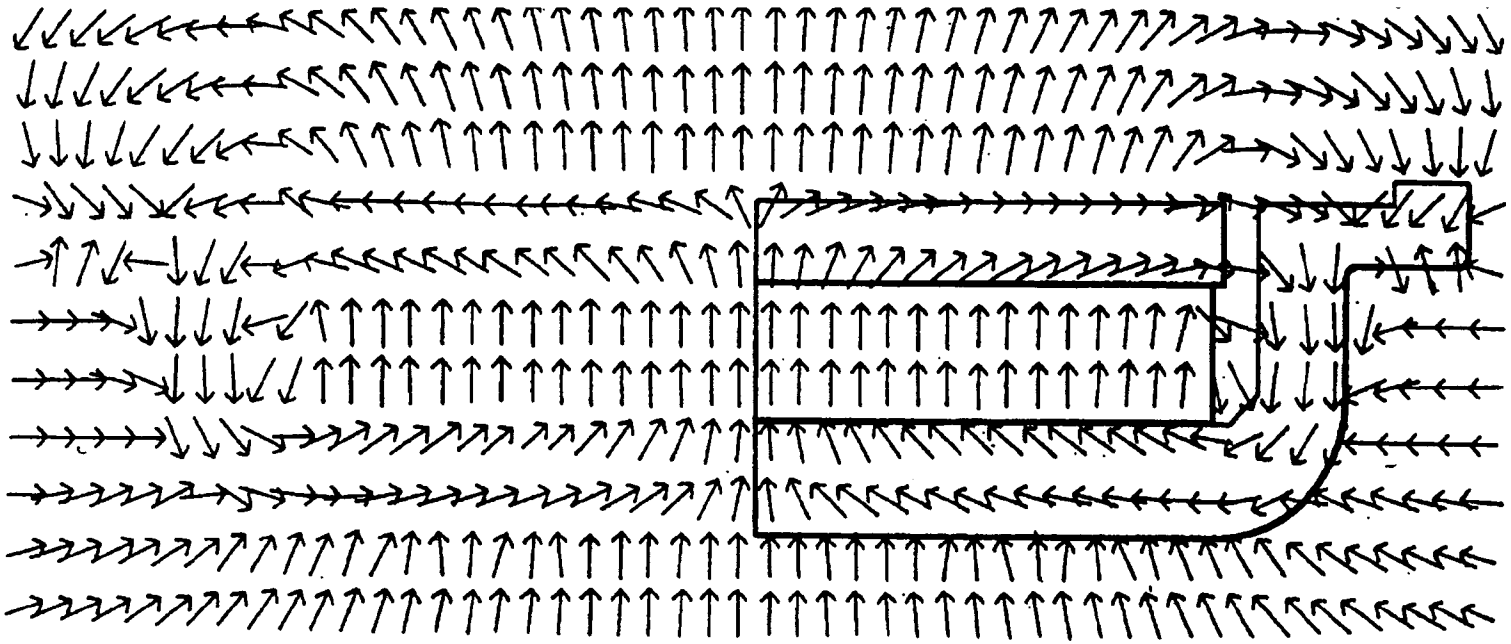
Figure 7:
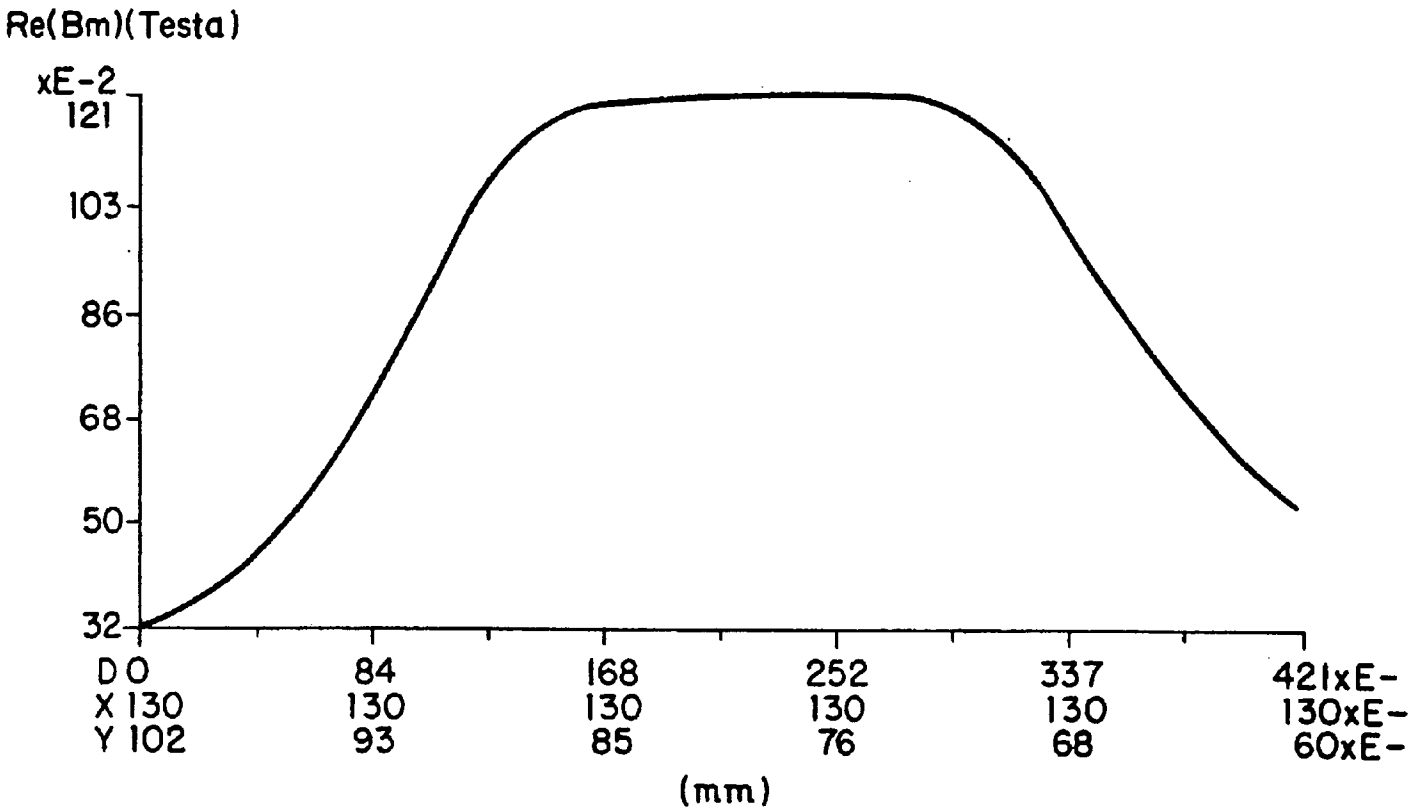
Figure 8:
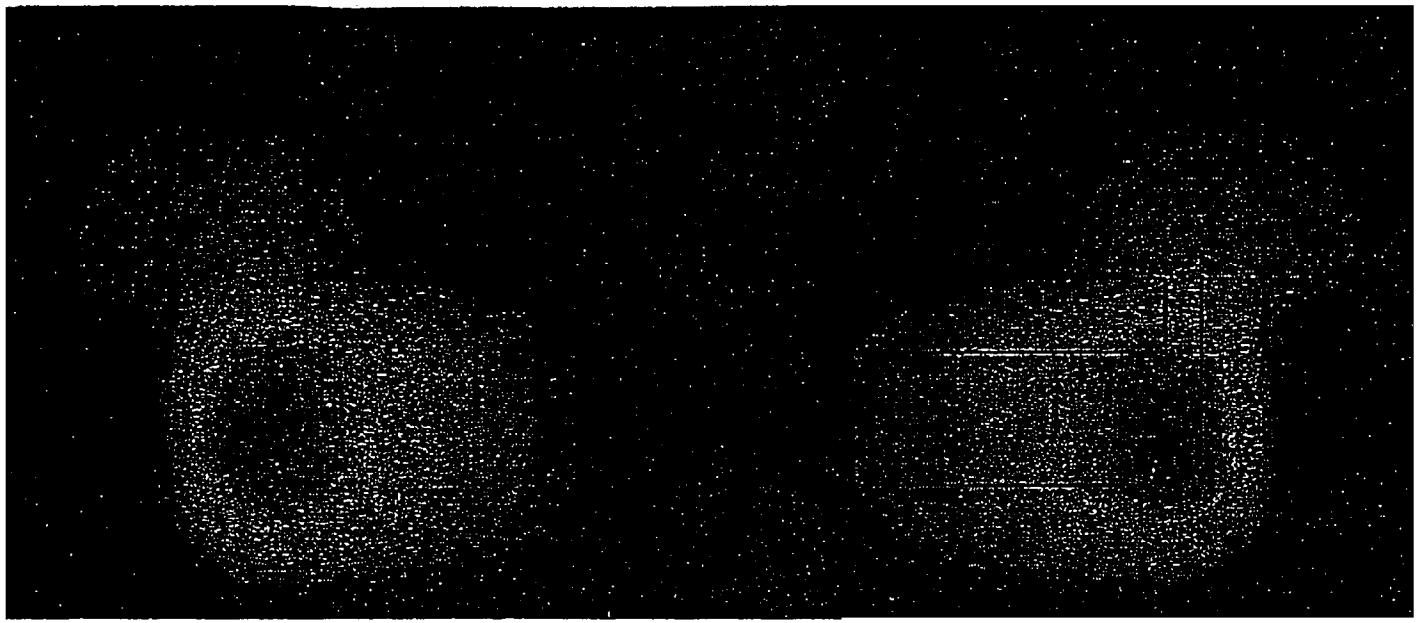

FIGS. 4A and 4B plot the flux paths/field lines of the annular magnet structure and gap area of the device of FIG. 1A, with continuous tone and with individual lines, respectively, indicating the very efficient use of the small magnet to define symmetrical flux paths while providing a ported magnet assembly.

In a prototype embodiment, the dual ring structure had an 8 millimeter center hole allowing air coupling and wiring. The inner neodymium ring had a 24.5 millimeter outer diameter and a radial thickness of 8.25 millimeters, while the outer ring had a 36 millimeter outer diameter and a radial thickness of 4.25 millimeters, so that the space between the two concentric magnets was 1.5 millimeters wide. Both magnets were 3.5 millimeters thick, thus employing a volume of magnetic material equal to (1.47+1.45)cc, or 2.97 cc, weighing 22.5 grams. The steel parts, the inner top plate, and outer top plate weighed 5 and 5.77 grams, respectively, with a total system weight of 48 grams, providing a flux density of 1.44 Tesla and a total energy of one hundred milliWatt seconds.

COMPARATIVE EXAMPLE 1

The value of these performance characteristics will be appreciated by consideration of FIGS. 5–8, illustrating features comparable to those of FIGS. 1A, 2, 3, and 4A, respectively, for a first comparison construction of the same total weight but using a single solid neodymium disk magnet optimized for the system. As shown, the energy is substantially lower than in the system of the invention, and the flux distribution in the central region of the solid disk is substantially wasted without contributing to increased gap density. The total energy in the gap is 65 milliWatt seconds with a total flux of 1.21 Tesla and a system weight of 49.5 grams, of which the outer shell forms a substantial portion. Thus, among the parameters discussed above, only one is improved, namely a lower cost due to the simpler slug of magnet and pole structure.

COMPARATIVE EXAMPLE 2

Figure 9:
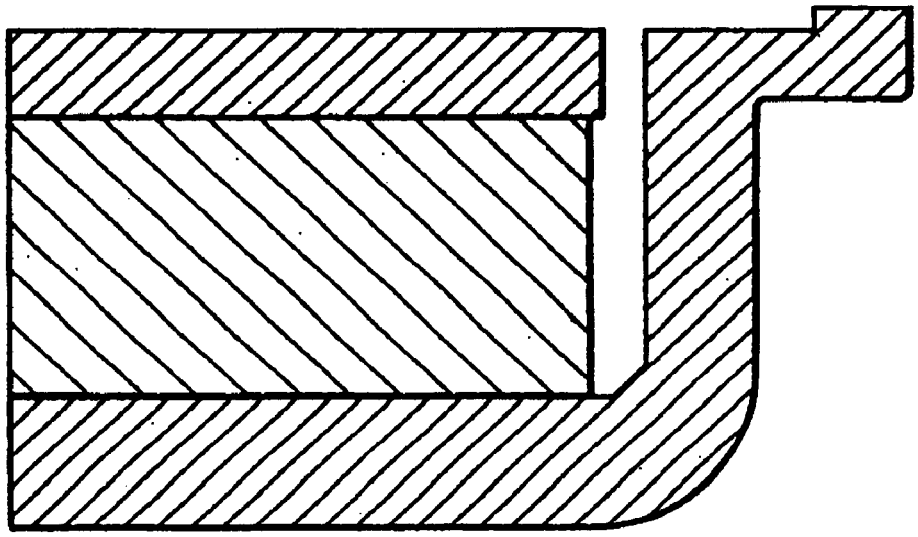
Figure 10:
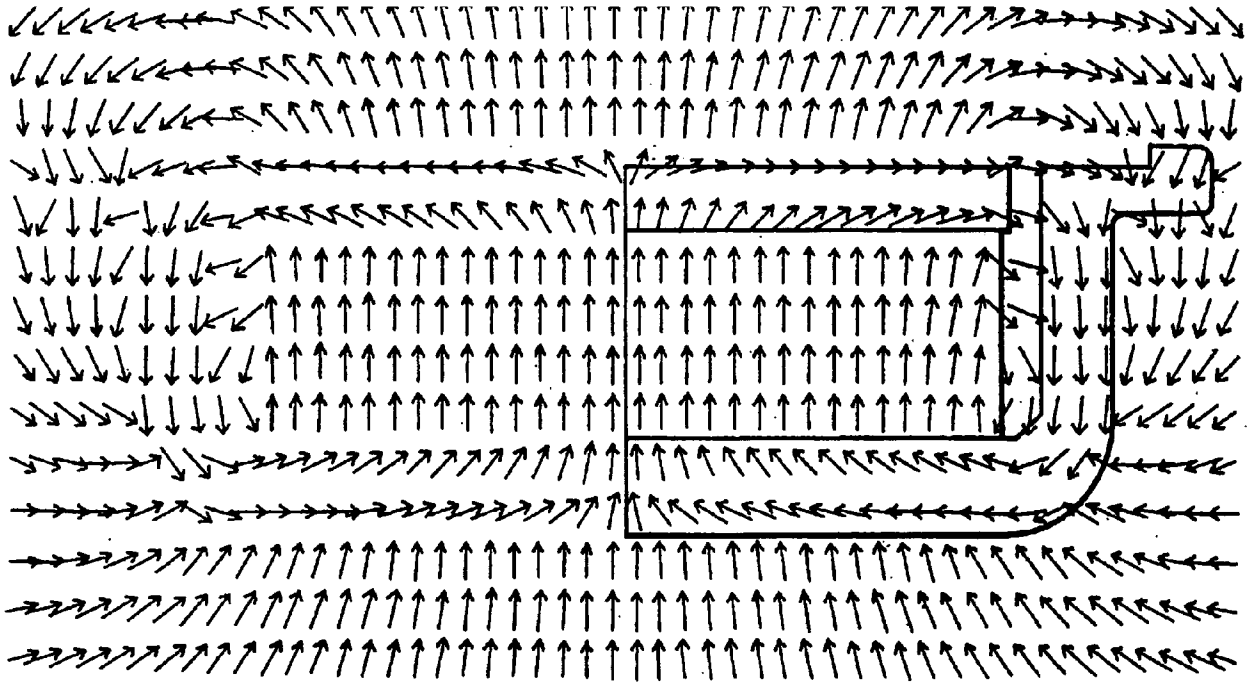
Figure 11:
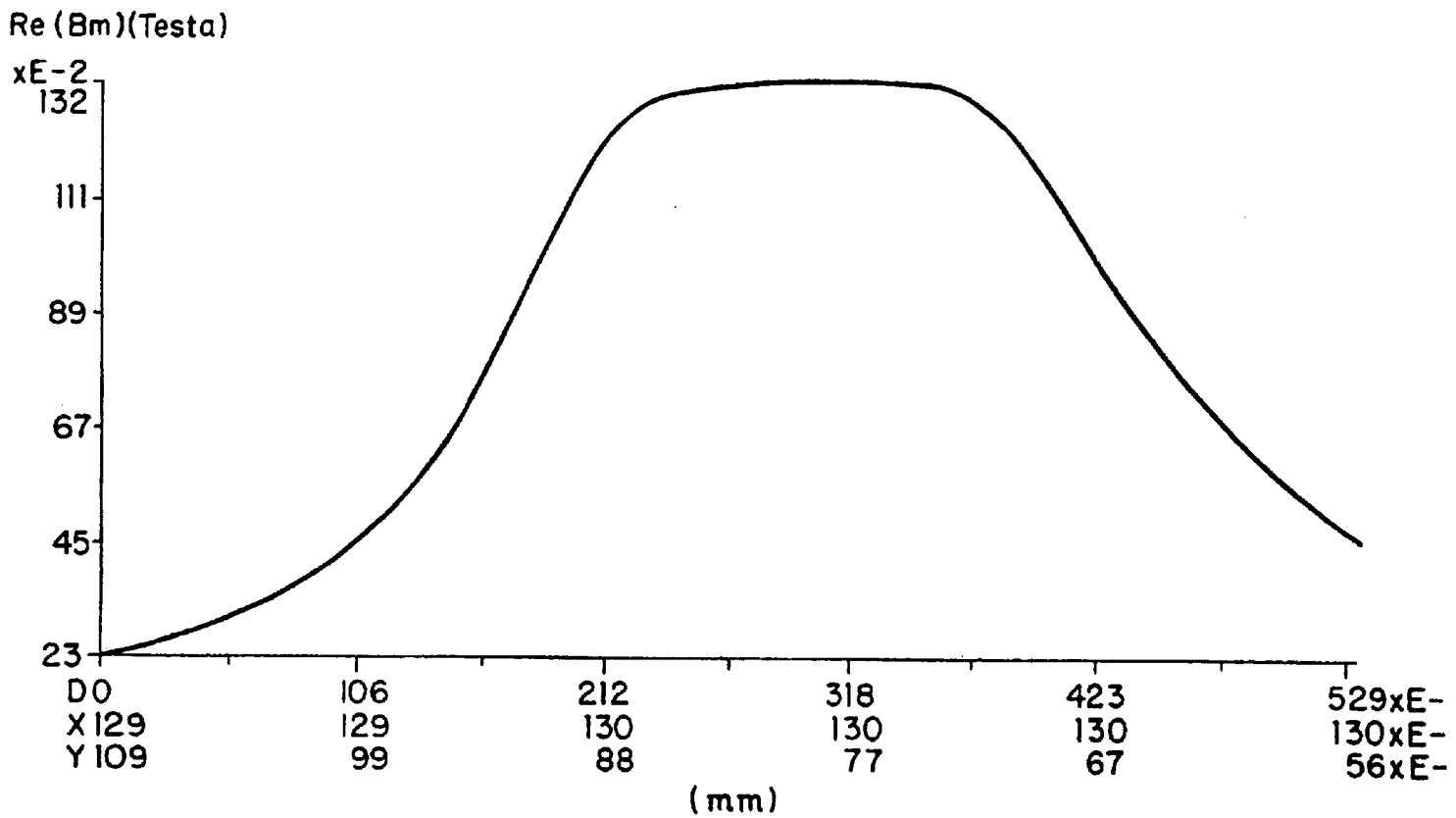
Figure 12A:
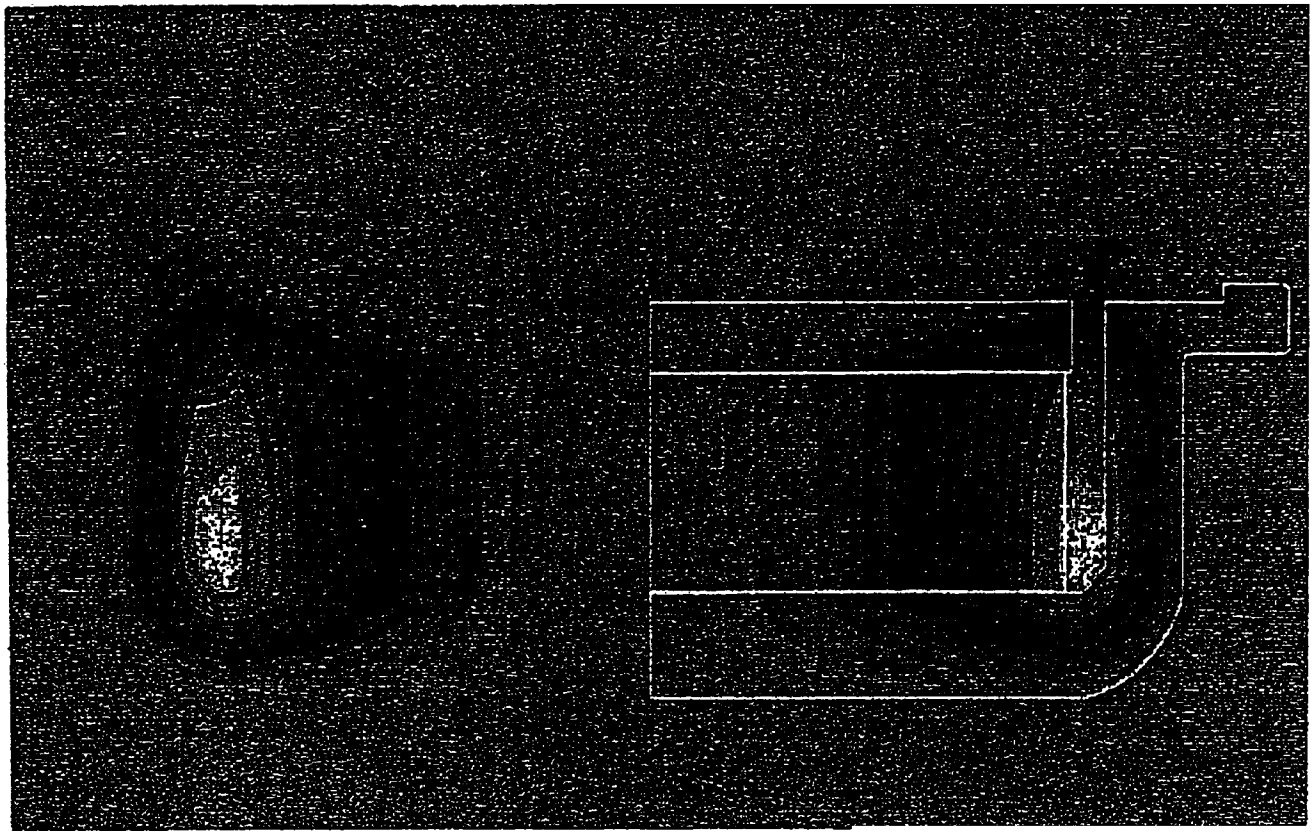
Figure 12B:
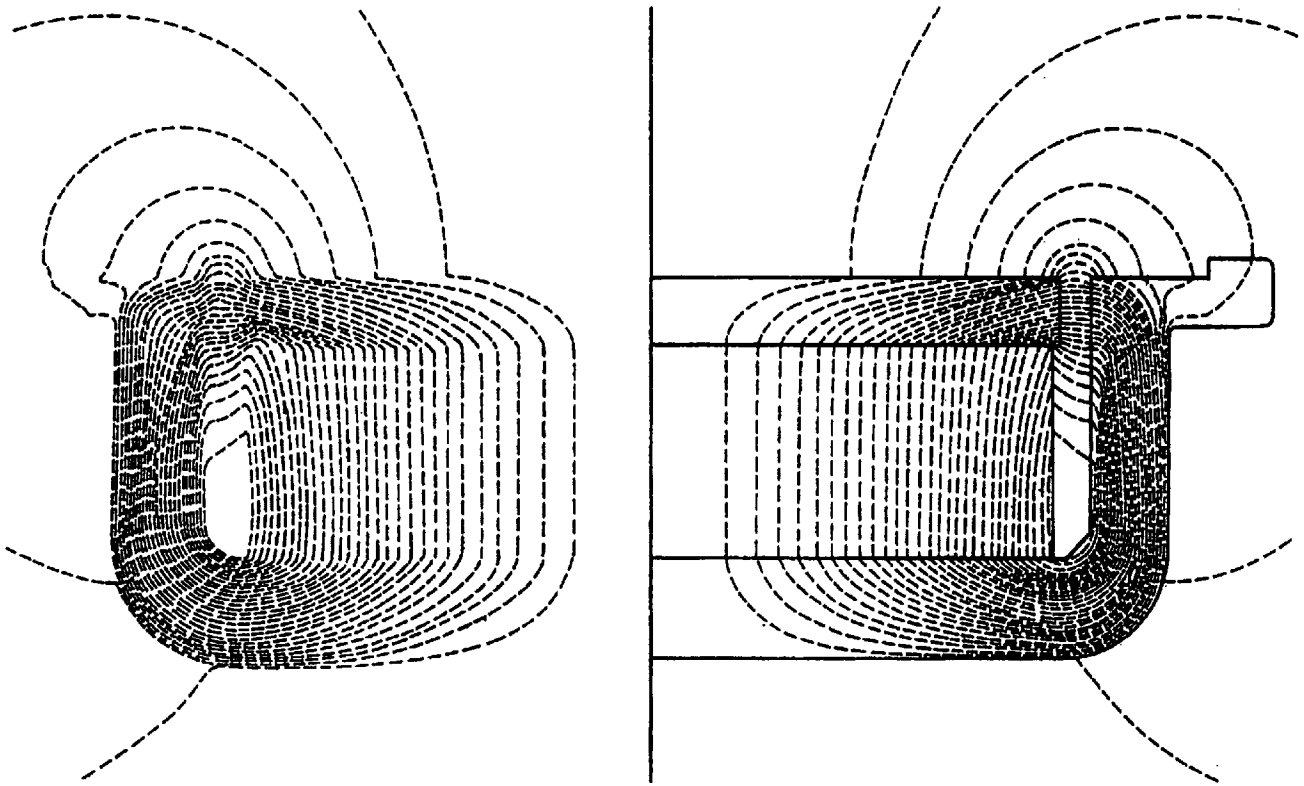

Another useful comparison is to a magnet structure as shown in FIG. 9 that uses the same amount of neodymium magnet as the system of FIGS. 1–4. In this example the magnet is a tall disk ten millimeters thick by 24.5 millimeters diameter weighing 12.55 grams. The top and bottom plate, similar to the ones of the preceding Example but with a deeper shunt, bring the total system weight up to 48.5 grams. The flux density is increased to only 1.32 Tesla, but the magnet depth is increased to 15.5 millimeters making the structure somewhat less suitable for shallow enclosure. FIGS. 10–12B show the flux density, flux distribution, field line models and overall geometry of this example.

COMPARATIVE EXAMPLE 3

Figure 13:
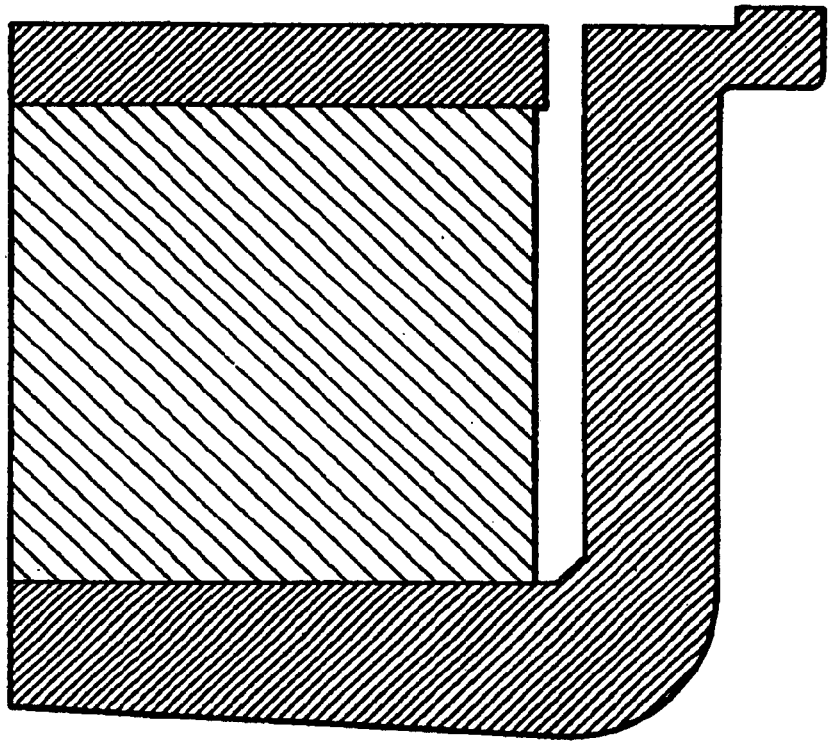
Figure 14:
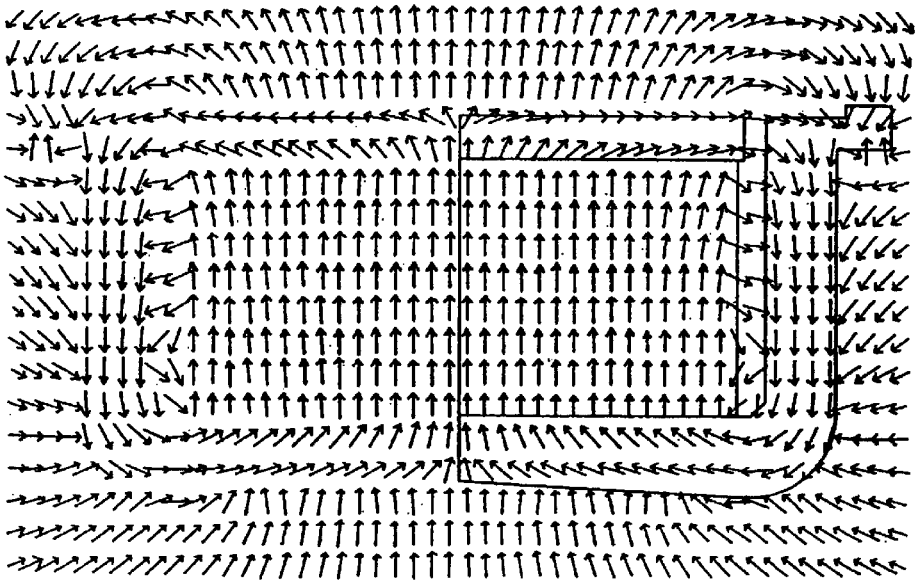
Figure 15:
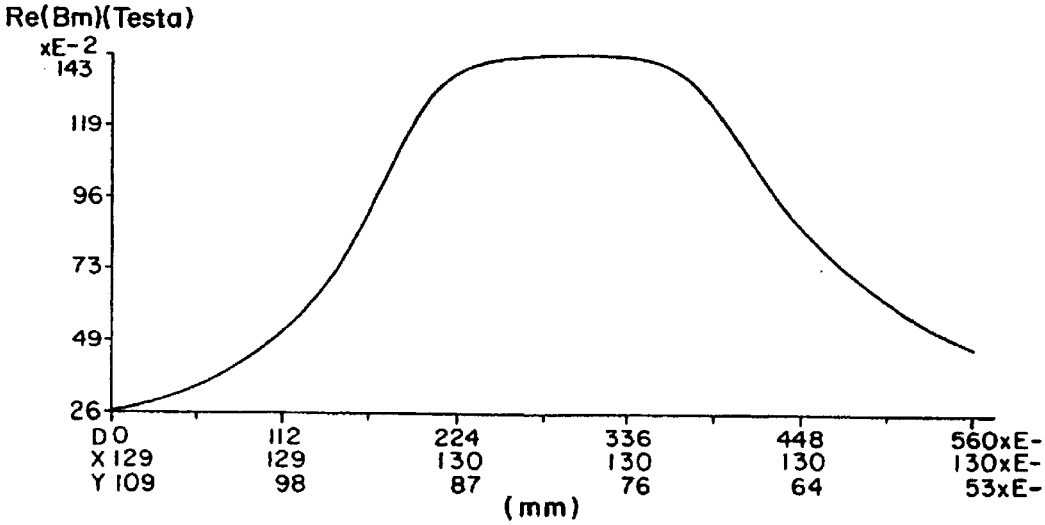
Figure 16A:
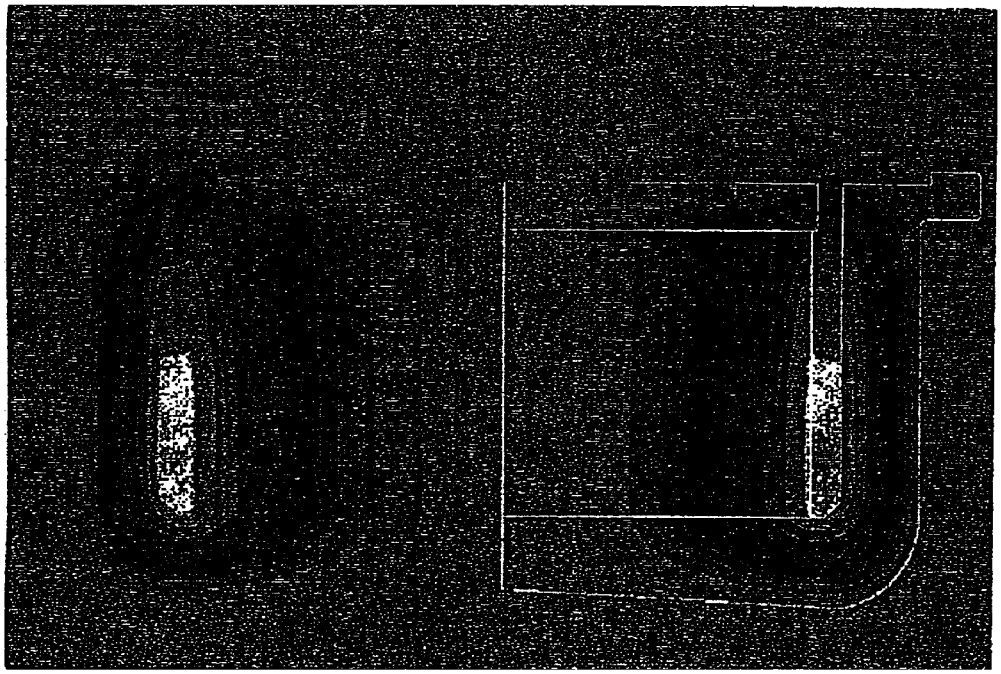
Figure 16B:
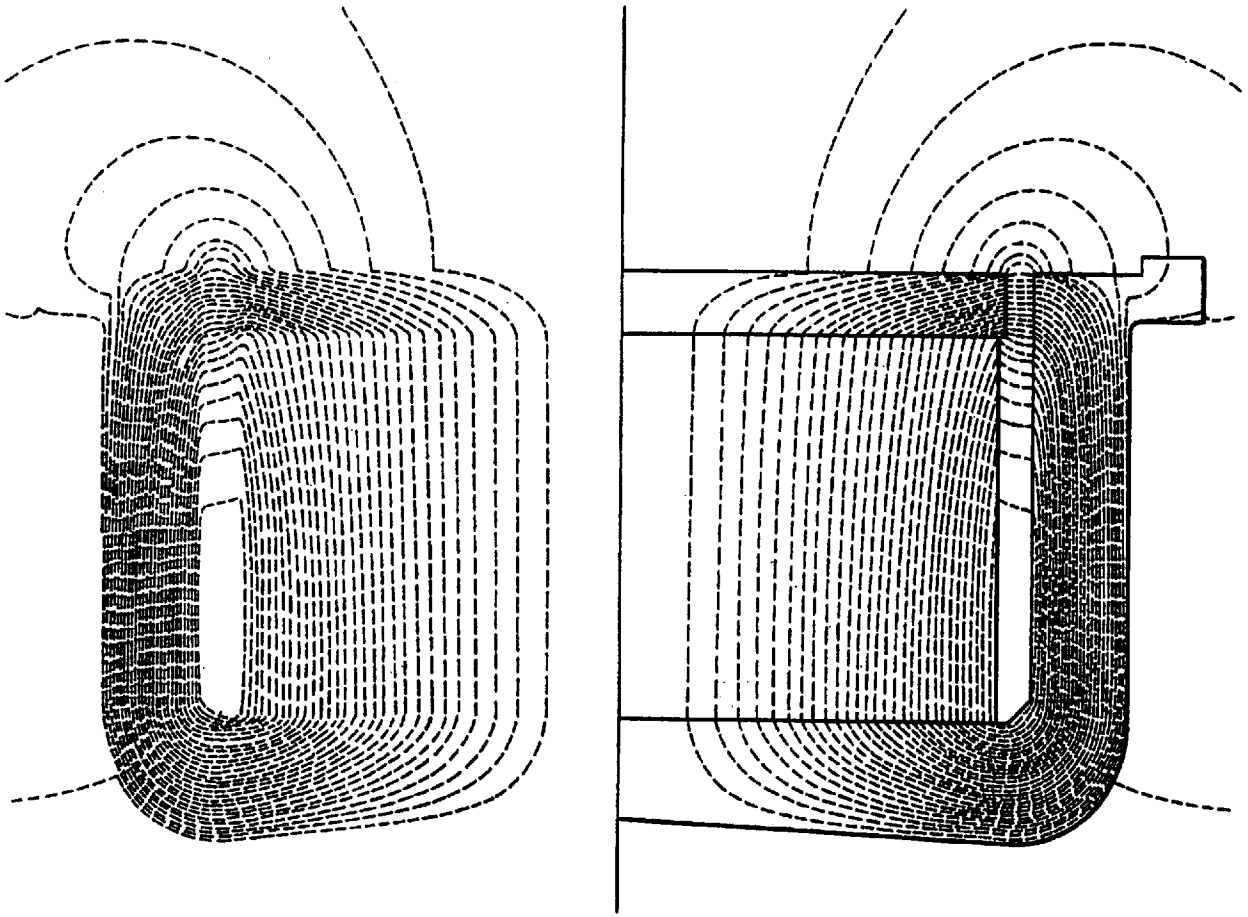

By way of further example, if one were to seek the same energy in the gap as the system of FIGS. 1–5 but using a disk magnet, the construction would be as shown in FIG. 13. In this case the magnet has a thickness of twelve millimeters, and weighs forty grams, with the outer shell and top plate bringing the total system weight up, to over one hundred grams. FIGS. 15–16B show the flux density, flux distribution, field line models and overall geometry of this example. This construction results in a magnet depth of 18.5 millimeters, too deep to work with flat panel speakers. The increased magnet weight also renders this design also more costly than the double ring design of FIG. 1.

Thus, it will be seen that the double ring magnet design achieves a high flux density in a light weight practical way. By contrast, the only conventional design of the same flux appears too deep, too heavy and too expensive. Not only do speakers of the invention efficiently concentrate the available flux in a narrow, shallow voice coil gap, but the center hole of the double ring design provides an opening through which the power wires are routed to supply the moving coil. This lowers speaker production costs by eliminating the delicate task of joining the drive lines to static coil terminals inside the speaker. It also achieves a smaller assembly size (since no space around the periphery need be allotted for cabling) and may simplify cabinet mounting methodology. The extraction of energy from the neodymium is exceedingly efficient, thereby increasing the acoustical efficiency of the complete linear drive motor. As noted above, the apertured magnet may also be employed to lower the stiffness of an enclosure in which the speaker mounts, or may be exploited for air coupling to an external tuned enclosure to damp or tune the response in combined speaker/enclosure systems.

The invention being thus disclosed and illustrative embodiments thereof described, further variations and modifications will occur to those skilled in the art and all such variations and modifications are considered to lie within the scope of the invention as defined by the claims appended hereto and equivalents thereof.

What is claimed is:

1. A magnet assembly for a speaker, such assembly comprising first and second annular magnets positioned coaxially and forming a radial gap therebetween, said first and second magnets being axially poled a shunt connected across one side of said first and second magnets a first pole piece having a first face, said first pole piece being positioned on the first magnet, and a second pole piece having a second face, said second pole piece being positioned on the second magnet said assembly defining a voice coil gap between the first and second faces such that magnetic flux is focused in said voice coil gap while leaving an opening centrally through said assembly wherein power leads for the voice coil are routed through the opening.

2. The magnet assembly of claim 1, wherein said first and second magnets are rare earth magnets.

3. The magnet assembly of claim 1, wherein said first and second magnets are neodymium magnets.

4. A speaker comprising a diaphragm a voice coil connected to the diaphragm, and a magnet assembly defining a flux gap, wherein the voice coil is positioned in the flux gap, said magnet assembly including a pair of concentrically-disposed annular magnets, a shunt positioned on and interconnecting one side of said magnets, and a pair of pole pieces at a second side of said magnets so as to efficiently focus magnetic flux between opposed faces of the pole pieces to form said voice coil gap, the magnets and shunt arranged to form a central opening for air coupling to a space behind the speaker, wherein power leads for the voice coil are routed through the central opening.

5. The speaker of claim 4, wherein the magnet assembly has a central opening for air coupling space behind the speaker.

6. The speaker of claim 5, further comprising an enclosure, and wherein said central opening couples into the enclosure.

* * * * *

UNITED STATES PATENT AND TRADEMARK OFFICE

CERTIFICATE OF CORRECTION

PATENT NO. : 7,006,653 B2
APPLICATION NO. : 10/456990
DATED : February 28, 2005
INVENTOR(S) : Godehard A. Guenther It is certified that error appears in the above-identified patent and that said Letters Patent is hereby corrected as shown below:

In Claim 5, Line 4, following “air coupling”, please insert --to--.

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,006,653 B2
APPLICATION NO. : 10/456990
DATED : February 28, 2006
INVENTOR(S) : Godehard A. Guenther It is certified that error appears in the above-identified patent and that said Letters Patent is hereby corrected as shown below:

In Claim 5, Line 4, following "air coupling", please insert --to--.

This certificate supersedes Certificate of Correction issued August 22, 2006.

Signed and Sealed this

Tenth Day of October, 2006

JON W. DUDAS
*Director of the United States Patent and Trademark Office*